US005539947A

United States Patent [19]

Kiraly

[11] Patent Number: 5,539,947

[45] Date of Patent: Jul. 30, 1996

[54] SWIMMING POOL VACUUM CLEANER HYDROFOIL

[76] Inventor: J. George Kiraly, 3605 Kingston Blvd., Sarasota, Fla. 34238

[21] Appl. No.: 441,207

[22] Filed: May 15, 1995

[51] Int. Cl.[6] ..... E04H 3/20

[52] U.S. Cl. ..... 15/1.7; 15/246; 15/257.1

[58] Field of Search ..... 15/1.7, 246, 257.01

[56] References Cited

U.S. PATENT DOCUMENTS

| | | | |
|---|---|---|---|
| 2,243,576 | 5/1941 | Otto | 15/1.7 X |
| 3,003,168 | 10/1961 | Shouldice . | |
| 3,402,413 | 12/1967 | Gibellina . | |
| 4,637,087 | 1/1987 | Feinberg . | |
| 4,733,427 | 3/1988 | Conrad | 15/1.7 X |
| 4,742,592 | 5/1988 | Addona | 15/1.7 |
| 4,776,053 | 10/1988 | Kiraly . | |
| 4,783,868 | 11/1988 | O'Callaghan . | |

FOREIGN PATENT DOCUMENTS

| | | |
|---|---|---|
| 1068216 | 7/1958 | Germany . |
| 584029 | 1/1947 | United Kingdom . |

*Primary Examiner*—Chris K. Moore
*Attorney, Agent, or Firm*—Charles J. Prescott

[57] ABSTRACT

A hydrofoil attachment for swimming pool vacuum cleaner heads which provides downward thrust during both pulling and pushing strokes. The hydrofoils are pivotally supported on a laterally extending rod. The rod is supported by triangular plates which mount on the axles of the wheels of the vacuum cleaner head.

10 Claims, 2 Drawing Sheets

24
36
50
24
42
52
56
14
44
54
40
20
12
10
30
12

24
46
24
48
34
36
54
D
32
50
28
C
52

24
E
24
32
34
F

SWIMMING POOL VACUUM CLEANER HYDROFOIL

BACKGROUND OF THE INVENTION

SCOPE OF INVENTION

This invention relates generally to swimming pool vacuum cleaners and more particularly to a hydrofoil attachment for improving the positioning of the vacuum cleaner against the pool surfaces.

PRIOR ART

One device which is widely used in cleaning the submerged surfaces of swimming pools is a vacuum cleaner. The vacuum cleaner has a head which may be supported by a plurality of wheels to keep the edges of the head only slightly above the pool surface. A hose, connected at one end to a vacuum and filtering system, is connected to the vacuum cleaner head to draw water and debris under the edges of the head to be carried away for filtering.

The vacuum cleaner head is moved by maneuvering a long pole pivotally connected to the head. When the head is being pushed by the person standing on the edge of the pool, part of the thrust exerted tends to properly maintain all of the wheels of the vacuum cleaner head on the pool surface. When the head is being pulled back, however, the wheels tend to lift off the pool surface and the vacuuming effect is lost or substantially reduced. The backward stroke of the vacuum head is consequently essentially wasted as a cleaning stroke. Even when pushing the head, water is forced between the pool surface and the bottom surface of the head to cause separation or planing of the head away from the pool surface.

In the past, the difficulty of maintaining a cleaning device against a submerged pool surface during both pushing and pulling strokes has been recognized and solutions have been proposed.

U.S. Pat. No. 3,003,168 to Shouldice, entitled Underwater Brush discloses a water foil which is pivotally mounted on a brush backing vane. The foil has a larger area above the pivot than below the pivot in order to move the foil to the proper position.

U.S. Pat. No. 3,402,413 to Gibellina entitled Swimming Pool Brush Guide discloses a guide designed to produce downward force on a brush during the pushing stroke and lifting force during the pulling stroke.

U.S. Pat. No. 4,637,087 to Feinberg entitled Swimming Pool Cleaner Attachment discloses a water foil which is attached to a swimming pool cleaning brush. The foil is attached in a fixed position, but it includes openings which are closed by a flexible flap when the brush is pushed and which are forced open by the flow of water when the brush is pulled. This structure is directed to aiding in the brushing of the vertical walls of a pool and performs its function during the pushing stroke.

An invention taught in G.B. 584029 is directed to a self-loading brush or broom for underwater surfaces which teaches a vane pivotable about a lateral axis positioned above the brush head back and forth at generally equal acute angles with respect to vertical. This pivoting action is effected by back and forth movement of the brush head.

A German patent, 1068214, teaches two separately movable vanes each disposed about a common laterally extending axis spaced above the brush head. Additional structure apparently responsive to direction of movement of the brush head serves to control the angular orientation of these separate vanes.

The recent U.S. patent to O'Callahan disclosed in U.S. Pat. No. 4,783,868 teaches a vane for under liquid cleaning a pivotal vane increases contact pressure of the brush during forward motion and then pivots to a non-impeding position upon backward motion.

The device taught in my previous U.S. Pat. No. 4,776,053 performs in a very similar way except in that the hydrofoil attachment disclosed there provides downward thrust during the pulling stroke and does not impede or generate thrust during the pushing stroke.

The present invention is provided so as to exert additional contact pressure between the cleaning head and the pool surface in both directions of cleaning head movement and to automatically reverse the position of the uniquely configured hydrofoil member to accomplish this.

BRIEF SUMMARY OF THE INVENTION

This invention is directed to a hydrofoil attachment for swimming pool vacuum cleaner heads which provides downward thrust during both pulling and pushing strokes and to automatically reverse hydrofoil positioning responsive to the direction of cleaner head movement. The hydrofoils are pivotally supported on a laterally extending rod. The rod is supported by triangular plates which mount on the axles of the wheels of the vacuum cleaner head.

It is therefore an object of this invention to provide hydrofoil apparatus for use with a swimming pool vacuum cleaner which will aid in keeping the vacuum cleaner head in proper operating position during both pulling and pushing strokes.

It is also an object of this invention to provide hydrofoil apparatus which is readily attached to conventional swimming pool vacuum cleaner heads.

In accordance with these and other objects which will become apparent hereinafter, the instant invention will now be described with reference to the accompanying drawings.

DETAILED DESCRIPTION OF THE INVENTION

Figure 1:
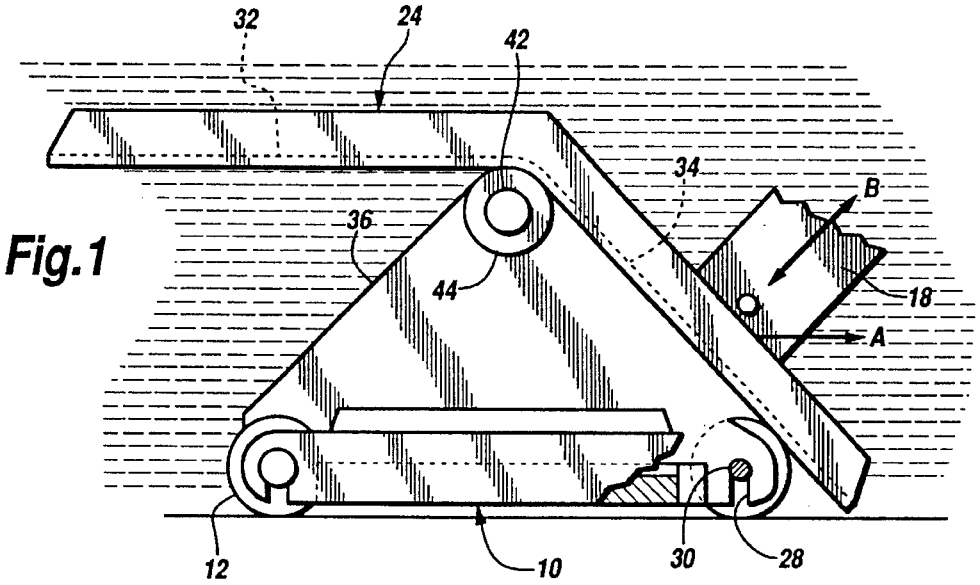
FIG. 1 is a side elevation view of a swimming pool vacuum cleaner head incorporating the hydrofoil apparatus of this invention.
Figure 2:
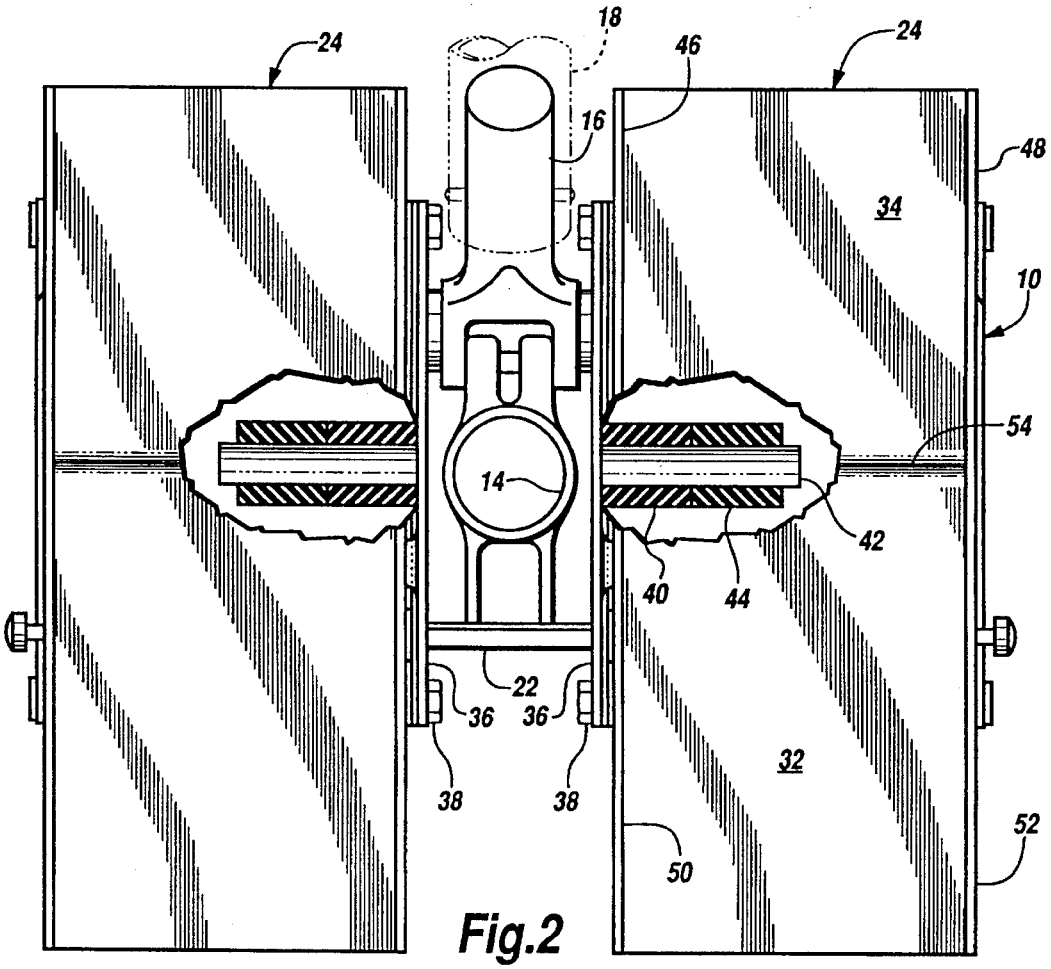
FIG. 2 is a top plan view of the device of FIG. 1.
Figure 3:
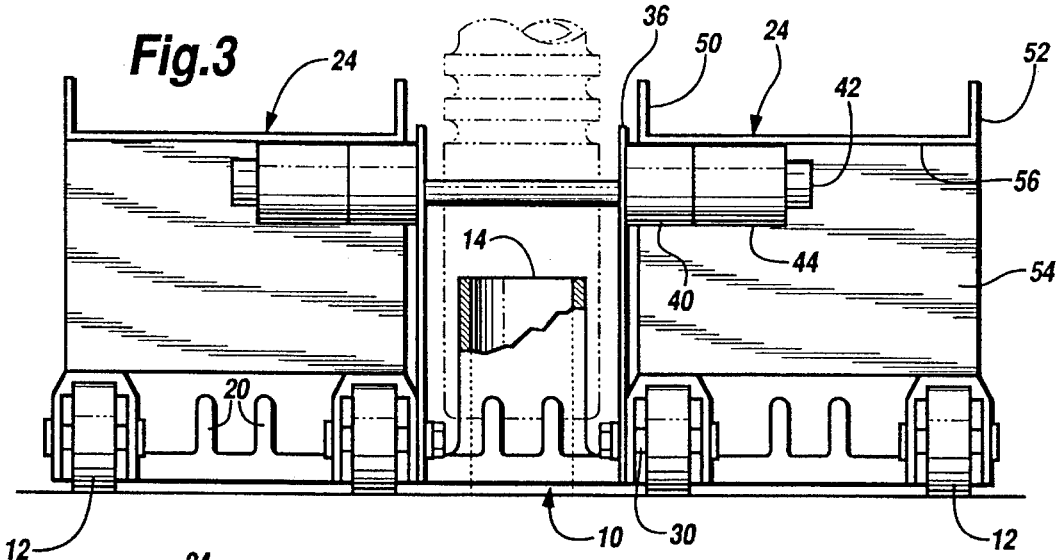
FIG. 3 is a front elevation view of the device of FIG. 1.

Referring now to the drawings, and particularly to FIGS. 1 to 3, the swimming pool vacuum cleaner head shown generally at numeral 10 is supported by a plurality of spaced and parallel disposed wheels 12 so as to be in proper operating position when all wheels 12 are on the pool surface. In this position, a small gap exists between the edges of the head and the pool surface. The head 10 includes a centrally located hose connection 14, and a pivotally mounted stub shaft 16 serving as a pole mount to which a hollow pole 18 may be connected. A plurality of parallel veins 20 are also provided which extend upwardly from head 10.

The invention generally includes two identical double-acting hydrofoil apparatus shown generally at numeral 24. Each of these hydrofoil apparatus 24 are independently pivotally mounted on laterally extending shafts or rods 42. Each shaft 42 is supported within cylindrical members 40 for added strength by a generally triangular plastic plate 36 at the apex thereof as shown. As best seen in FIG. 1, a slot 28 is provided at the bottom of the front and rear apexes of each plate 36 to facilitate mounting on axles 30 of head 10. Since the axles 30 of the wheels 12 of the commercially available vacuum cleaner head 10 are the shafts of through bolts and are held in place by nuts, it is a simple matter to loosen the appropriate nuts enough to install each plate 36.

Each of the hydrofoils 24 includes two rectangular, flat panel portions 32 and 34 formed of sheet plastic material which have a common transverse boundary line 54. The panel portions 32 and 34 are generally oriented at an obtuse included angle one to another as seen in FIG. 1. Upwardly extending flanges 46, 48, 50 and 52 are provided along the side margins of panel portions 32 and 34, respectively, so as to enhance effectiveness by preventing water from flowing over the side margins rather than flowing as desired along the entire length of each panel portion 32 and 34.

Figure 4:
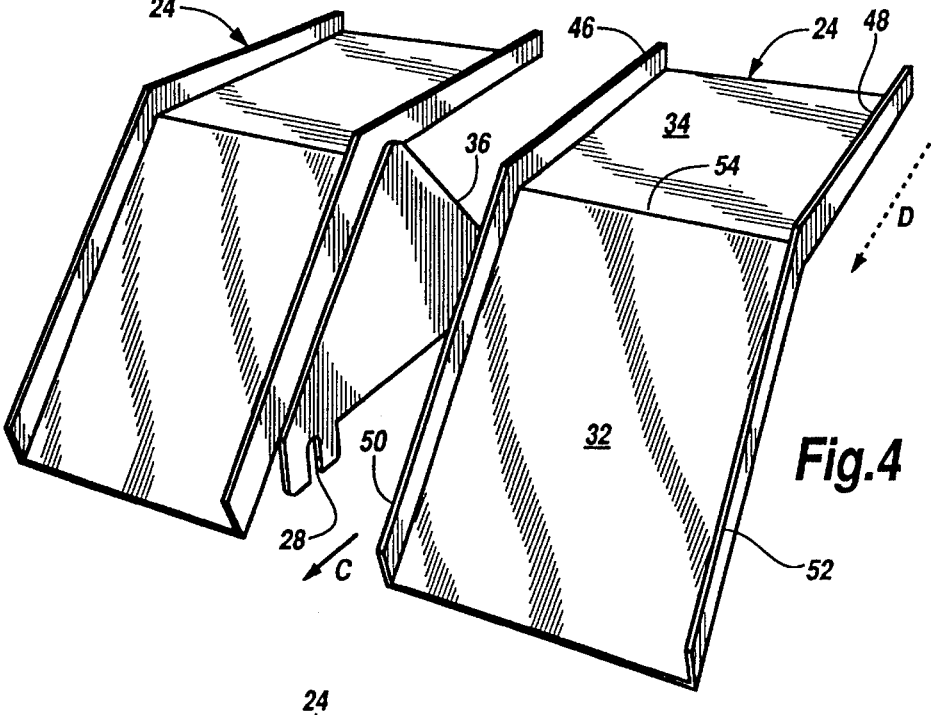
FIG. 4 is a perspective view of a hydrofoil attachment in accordance with the invention shown self-positioned during forward movement.
Figure 5:
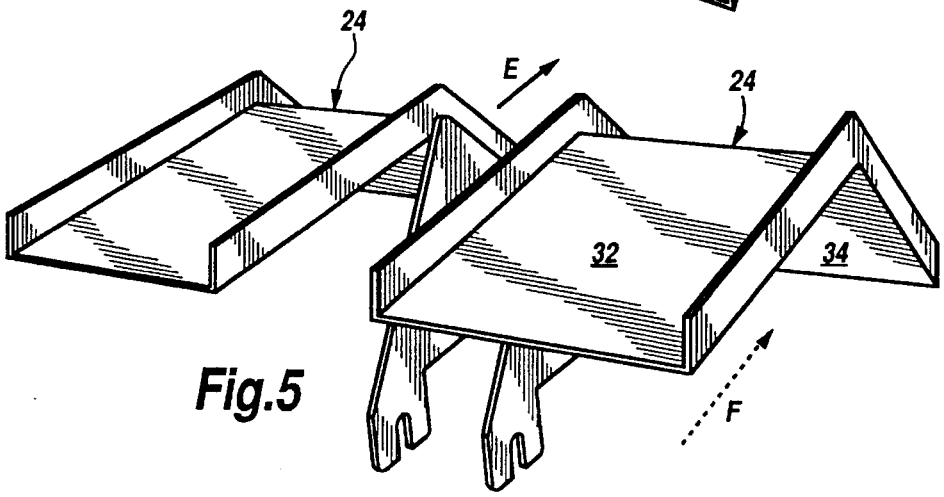
FIG. 5 is a perspective view of the hydrofoil attachment of FIG. 4 shown self-positioned during rearward movement.

In FIG. 1, the vacuum head 10 is shown being moved in the direction of arrow A by pulling on handle 18 in the direction of arrow B. Referring additionally to FIGS. 4 and 5, the pair of hydrofoils 24 are there shown in alternate operating positions. In FIG. 4, the vacuum head (not shown) is being moved along the surface of the pool in the direction of the arrow C and panel portions 34 are thus moved into an angular orientation with respect to the water flow. Downward thrust is thus generated to maintain better surface contact of the vacuum head 10 against the pool surface.

Still referring to FIG. 4, when motion reversal is effected, the water flow will impinge against the under surface of panel portions 34 in the direction of arrow D to reorient the hydrofoils 24 into the position shown in FIG. 5 and visa-versa.

In FIG. 5, the motion of the vacuum head (not shown) is in the direction of arrow E and panel portions 34, angularly oriented with respect to water flow thereby, generate downward force against the pool surface to maintain the vacuum head in contact therewith.

Again, reversal of the movement from arrow E in FIG. 5 results in the immediate water flow contact in the direction of arrow F against the undersurface of panel portions 34 to reorient the hydrofoils 24 back into the orientation shown in FIG. 4.

The obtuse included angle between panel portions 32 and 34 about transverse margin 54 therebetween (about 135°) is selected such that, when one of the panels such as 34 shown in FIG. 1 contacts against a portion of the vacuum head 10 such as the wheel 12 as shown, the other panel portion 32 is generally parallel to the pool surface so as to minimize any unnecessary or unuseful water drag.

Thus, the hydrofoils 24, freely pivotable on shafts 42, act very quickly and responsively to the back and forth movement of the vacuum head 10 against the pool surface during cleaning operations so as to generate useful additional downward force against the pool surface to maintain the vacuum head 10 in direct contact against the pool surface being cleaned at all times.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. Swimming pool vacuum cleaner hydrofoil apparatus for use in combination with a swimming pool vacuum cleaner head having a substantially flat body supported by a plurality of spaced and parallel disposed wheels and a centrally located pivoted pole mount comprising:

a pair of hydrofoils each having first and second panels of similar size and oriented at an obtuse included angle therebetween;

hydrofoil pivot means laterally extending generally parallel to and spaced centrally above the flat body of the vacuum cleaner head for independently pivotally supporting each said hydrofoil about a pivotal axis lying between said first and second panels;

pivot rod support means for mounting said pivot rod means to the vacuum cleaner head;

a trailing edge portion of each said first and second panels alternately limiting the pivoting of said hydrofoils by abutting the vacuum cleaner head;

one said panel of each said hydrofoil oriented generally parallel to and above the vacuum cleaner head when said trailing edge portion of the other said panel is abutted against the vacuum cleaner head.

2. Swimming pool vacuum cleaner hydrofoil apparatus in accordance with claim 1, wherein:

said pivot rod support means is positioned adjacent to and on both sides of the pole mount.

3. Swimming pool vacuum cleaner hydrofoil apparatus in accordance with claim 2, wherein:

said pivot rod support means comprise flat, triangular shaped plates orthogonally oriented with respect to the vacuum cleaner head.

4. Swimming pool vacuum cleaner hydrofoil apparatus in accordance with claim 3, wherein:

the wheels of the vacuum cleaner head are mounted on axles and said plates have slots to fit over the axles.

5. Swimming pool vacuum cleaner hydrofoil apparatus in accordance with claim 1, wherein:

said first and second panels include upturned flanged side margins.

6. In a swimming pool vacuum cleaner head having a substantially flat body supported by a plurality of spaced and parallel disposed wheels mounted on axles and a centrally located pivoted pole mount, the improvement comprising:

a pair of hydrofoils each having first and second panels of similar size and oriented at an obtuse included angle therebetween;

hydrofoil pivot means laterally extending generally parallel to and spaced centrally above the flat body of the vacuum cleaner head for independently pivotally supporting each said hydrofoil about a pivotal axis lying between said first and second panels;

pivot rod support means for mounting said pivot rod means to the vacuum cleaner head;

a trailing edge portion of each said first and second panels alternately limiting the pivoting of said hydrofoils by abutting the vacuum cleaner head;

one said panel of each said hydrofoil oriented generally parallel to and above the vacuum cleaner head when said trailing edge portion of the other said panel is abutted against the vacuum cleaner head.

7. A hydrofoil attachment for swimming pool cleaning devices comprising:

a pair of pivot rod supports each connectable uprightly and laterally spaced from a central portion of the swimming pool cleaning device;

each of said supports having an upper portion having a laterally extending pivot rod and a lower portion formed to attach to the swimming pool cleaning device;

a pair of hydrofoils each having first and second panel portions oriented at an obtuse included angle therebetween and pivotally mounted on one said pivot rod about a pivotal axis position in close proximity to a transition between said first and second panels.

8. A hydrofoil attachment in accordance with claim 7, wherein:

there are two hydrofoils and two pivot rod supports.

9. A hydrofoil attachment in accordance with claim 8, wherein:

said pivot rod supports are generally triangular in shape.

10. A hydrofoil attachment in accordance with claim 7, wherein:

said first and second panel portions including upturned flanges extending along each side margin thereof.

* * * * *